United States Patent [19]

Turner

[11] Patent Number: 4,583,563

[45] Date of Patent: Apr. 22, 1986

[54] COMBINED TOOTHBRUSH AND TOOTHPASTE DISPENSER

[76] Inventor: Burton S. Turner, 3438 W. Mott Ave., Flint, Mich. 48504

[21] Appl. No.: 522,786

[22] Filed: Aug. 12, 1983

[51] Int. Cl.[4] ..... A45D 44/18

[52] U.S. Cl. ..... 132/84 R; 132/84 B; 401/154

[58] Field of Search ..... 401/152, 154, 156, 280, 401/281, 28, 132, 133; 132/84 R, 84 B, 84 D; 222/93, 94, 95, 104, 105

[56] References Cited

U.S. PATENT DOCUMENTS

| | | | |
|---|---|---|---|
| 1,250,454 | 12/1917 | Heard, Jr. | 401/154 |
| 1,677,194 | 7/1928 | Mendoza | 401/281 |
| 1,736,146 | 11/1929 | Ansehl | 222/104 |
| 1,966,369 | 7/1934 | Yates et al. | 401/154 |
| 2,081,792 | 5/1937 | Cassanos et al. | 401/28 |
| 2,218,290 | 10/1940 | Moricich | 222/104 |
| 2,291,282 | 7/1942 | Hollenbeck | 401/152 |
| 2,376,222 | 5/1945 | Barlow | 222/104 |
| 2,562,937 | 8/1951 | Moricich | 401/154 |
| 2,634,025 | 4/1953 | Hausner | 222/104 |
| 2,867,830 | 1/1959 | Usdavin | 401/154 |
| 3,407,968 | 10/1968 | Fiquet et al. | 222/104 |
| 3,549,268 | 12/1970 | Casselman | 401/154 |
| 3,755,848 | 9/1973 | Mutrie | 15/184 |
| 4,332,497 | 6/1982 | Rodriguez | 401/154 |

*Primary Examiner*—Gene Mancene
*Assistant Examiner*—Carolyn A. Harrison
*Attorney, Agent, or Firm*—Barnes, Kisselle, Raisch, Choate, Whittemore & Hulbert

[57] ABSTRACT

A combined toothbrush and toothpaste dispenser, and a disposable toothpaste cartridge for use therein, comprising a brush having a hollow neck and a base with a non-circular opening adapted to receive a complementary non-circular mouth on a disposable toothpaste cartridge. A split tubular element is adapted to be assembled to the brush base and is rotatable with respect thereto. Ribs on the tubular element are disposed so as to clamp the mouth-remote end of the toothpaste cartridge so that rotation of the tubular elememt with respect to the brush base squeezes toothpaste from the cartridge and through the brush neck to the brush head. A tapering shoulder on the toothpaste cartridge adjacent to the mouth cooperates with a ledge on the split tubular element for preventing sliding removal of the mouth from the brush base opening during use. In one embodiment of the invention, the split tubular element forms the handle of the combined toothbrush and toothpaste dispenser, while in another embodiment the handle is integral with the brush and the split tubular element is slidably telescopically received therewithin.

19 Claims, 17 Drawing Figures

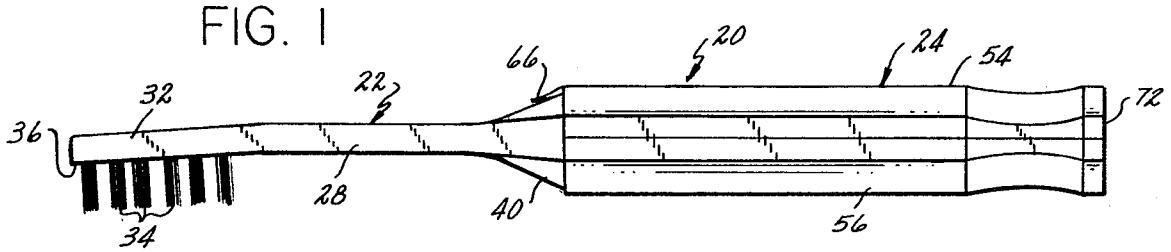
FIG. 1
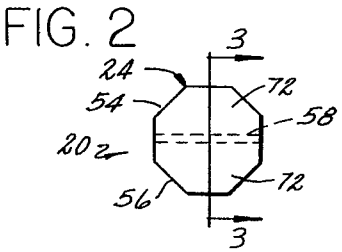
FIG. 2
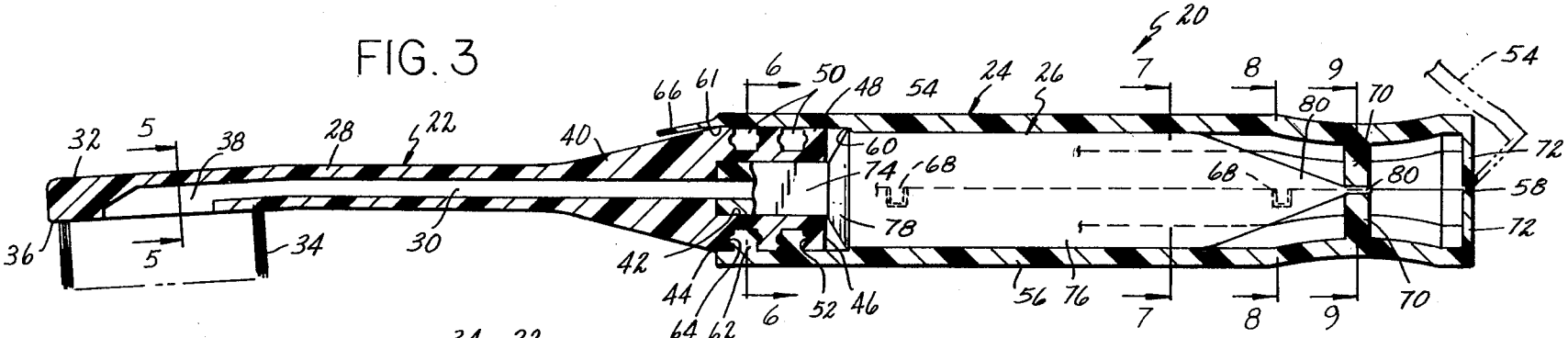
FIG. 3
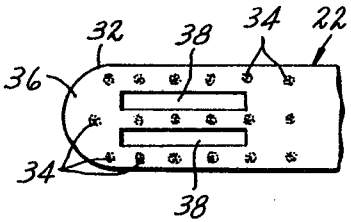
FIG. 4
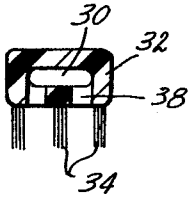
FIG. 5
FIG. 6
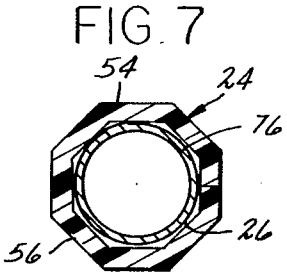
FIG. 7
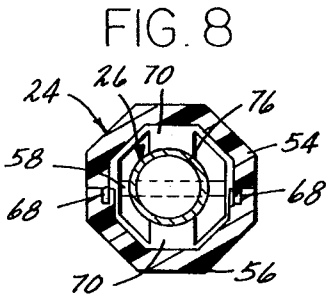
FIG. 8
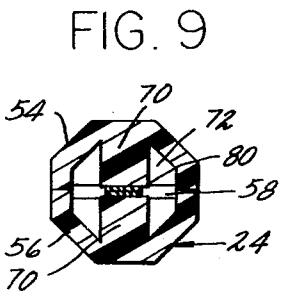
FIG. 9

COMBINED TOOTHBRUSH AND TOOTHPASTE DISPENSER

The present invention is directed to combined toothbrush and toothpaste dispensers, and to disposable toothpaste cartridges adapted for use therein.

An object of the present invention is to provide a combined toothbrush and toothpaste dispenser which is economical to manufacture, which may be readily used by either children or adults, and which includes a disposable toothpaste cartridge which may be easily and quickly replaced when empty.

Another object of the present invention is to provide a disposable toothpaste cartridge adapted for use in a toothpaste dispenser which may be readily assembled into the dispenser, and which may be easily removed and replaced when empty.

The invention, together with additional objects, features and advantages thereof, will be best understood from the following description, the appended claims and the accompanying drawings in which:

FIG. 1 is a side elevational view of a combined toothbrush and toothpaste dispenser in accordance with one presently preferred embodiment of the invention;

FIG. 2 is an end elevational view of the dispenser of FIG. 1;

FIG. 3 is a sectional view of the dispenser of FIG. 1 taken generally along the line 3—3 in FIG. 2;

FIG. 4 is a fragmentary bottom view of the toothbrush head featuring the toothbrush bristles and toothpaste outlet openings;

Figure 11:
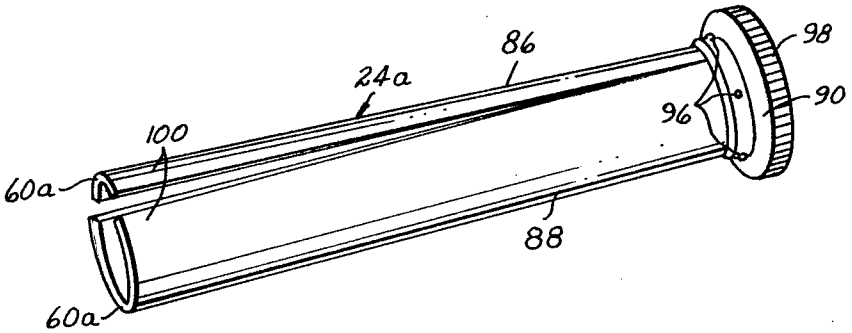
Figure 10:
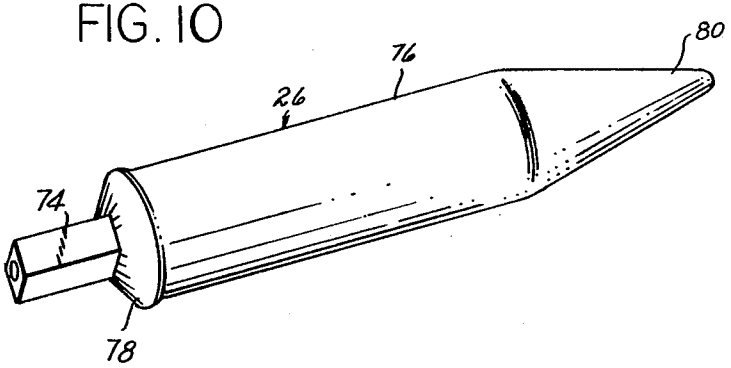
Figure 13:
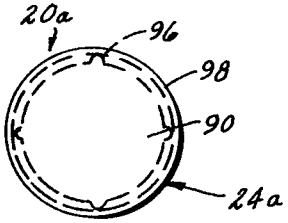
Figure 12:
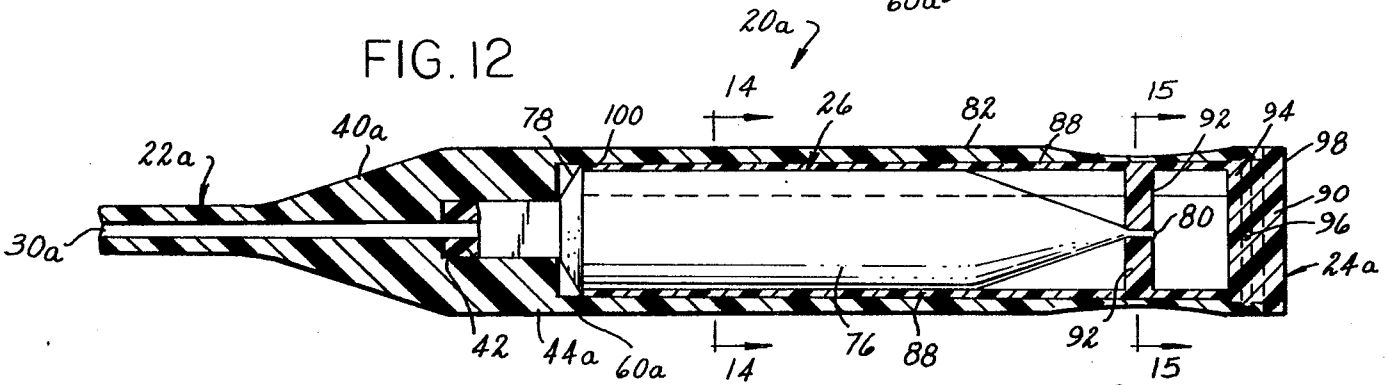
Figure 17:
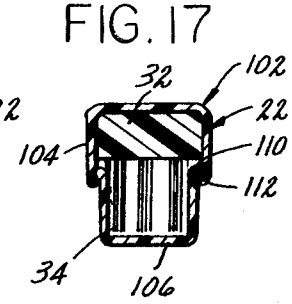
Figure 16:
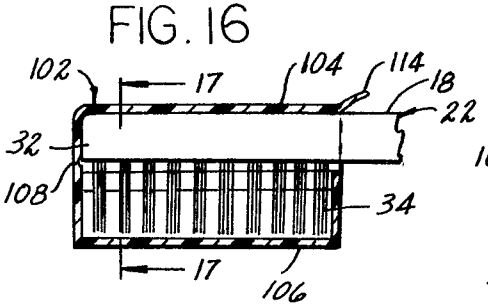
Figure 15:
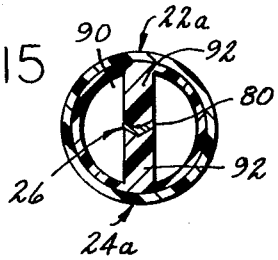
Figure 14:
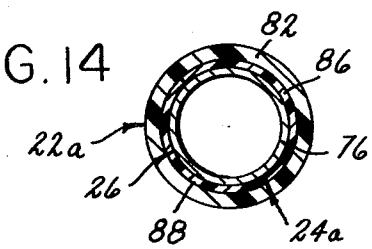

FIGS. 5, 6, 7, 8 and 9 are sectional views taken along the respective lines 5—5, 6—6, 7—7, 8—8 and 9—9 in FIG. 3;

FIG. 10 is a perspective view of a replaceable toothpaste cartridge in accordance with the present invention;

FIG. 11 is a perspective view of a portion of a combined toothbrush and toothpaste dispenser in accordance with a modified embodiment of the invention;

FIG. 12 is a fragmentary sectional view similar to that of FIG. 3 illustrating such modified embodiment of the invention;

FIG. 13 is an end elevational view of the embodiment of FIG. 12;

FIGS. 14 and 15 are sectional views taken along the respective lines 14—14 and 15—15 in FIG. 12;

FIG. 16 is a sectional view of a brush head cap suitable for use in combination with the present invention; and FIG. 17 is a sectional view taken along the line 17—17 in FIG. 16.

FIGS. 1-10 illustrate a presently preferred embodiment 20 of a combined toothbrush and toothpaste dispenser in accordance with the present invention as comprising a brush 22, a split tubular handle 24 and a disposable toothpaste cartridge 26 contained within handle 24. Brush 22 comprises an elongated hollow generally rectangular neck 28 having a passage 30 (FIGS. 3 and 5) extending axially therethrough. A brush head 32 is disposed at one end of neck 28 integrally with the latter and angulated with respect thereto. A plurality of bristles 34 (FIGS. 1, 3 and 4) are disposed in three parallel rows projecting from the lower face 36 of head 32 which is at an acute angle to the contiguous surface of neck 28. Neck passage 30 terminates in parallel rectangular openings 38 (FIGS. 3-5) in face 36 between rows of bristles 34.

The opposing or head-remote end of brush neck 28 flares into an integral base 40 (FIGS. 1, 3 and 6). Passage 30 terminates within base 40 in an enlarged counterbore or opening 42 which is surrounded and defined by an annular wall 44. In accordance with one important aspect of the present invention, opening 42 is of non-circular cross section, preferably polygonal cross section, and most preferably of square cross section, as best seen in FIG. 6. Annular wall 44, which is an integral part of base 40, has an axially facing end surface 46 directed away from brush head 32 and a radially outwardly facing cylindrical surface 48 (FIGS. 3 and 6) coaxial with opening 42. A pair of axially spaced circumferentially continuous channels 50 are formed in radially facing surface 48, with each channel 50 being of generally rectangular contour and having an opposed pair of circumferentially continuous part-circular channels 52 in the side walls thereof.

Handle 24 comprises a pair of opposed part-tubular segments 54,56 joined to each other at one end by an integral hinge 58 (FIGS. 2, 3 and 9). Part-tubular handle segments 54,56 are of generally uniform thickness and cooperate in assembly to form a non-circular outer cross section, preferably an octagonal cross section as best seen in FIGS. 2 and 7-8. Thus, the major portion of the internal cavity formed by segments 54,56 in assembly is of octagonal cross sectional contour (FIGS. 7 and 8). The internal cavity surface of segments 54,56 terminate remotely of hinge 58 in an axially outwardly facing ledge 60 (FIG. 3), from which segments 54,56 further extend with the internal surfaces 61 thereof forming a cylinder of revolution (FIG. 6) closely fitting over cylindrical surface 48 of brush base 40. A pair of axially spaced ribs 62 (FIGS. 3 and 6) are formed on handle segment 56 and project radially inwardly from cylindrical surface 61 so as to be received within channels 50 on base wall 44. A pair of oppositely projecting part-circular axial arcuate ribs 64 on the side surfaces of ribs 62 are received by snap fit within channels 52 so as to assemble handle segment 56 by snap fit to base 40 while permitting rotation of handle 24 with respect to brush 22 about the axis of opening 42. A tab 66 integrally projects forwardly from the end of handle segment 54. The opposing longitudinal edges of handle segments 54,56 include pin and socket locking means 68 (FIGS. 3 and 8) for holding the part tubular segments together in assembly over base 40 with ribs 62,64 received in channels 50,52 as previously described and with ledge 60 spaced from the opposing face 46 of brush base wall 44, as best seen in FIG. 3. A pair of opposed ribs 70 are formed on handle segments 54,56 at a position spaced from ledge 60 and project into the handle cavity in assembly, as best seen in FIGS. 3 and 9. Segments 54,56 terminate in a pair of end wall segments 72 which are joined to each other by integral hinge 58 (FIGS. 2, 9 and 9).

Toothpaste cartridge 26 comprises a mouth 74 (FIGS. 3, 6 and 10) in the form of a hollow stem having a non-circular outer surface geometry which is complementary to the cross sectional geometry of opening 42 in brush base 40, i.e. square in the preferred embodiments. The body 76 of cartridge 26 includes a conical shoulder 78 projecting radially and axially from mouth 74 and terminating remotely thereof in a rigid periphery. Cartridge body 76 is generally cylindrical and has a circular cross section throughout its length, terminating at the end remote from mouth 74 in an axially tapering conical end 80. Mouth 74 and shoulder 78 may be constructed of relatively rigid plastic material and the remainder of body 76 of collapsible material in a manner similar to construction of conventional toothpaste cartridges. Suitable toothpaste is, of course, contained within cartridge 26.

In assembly, handle 24 is first assembled to brush 22 by snapping ribs 62,64 into channels 50,52 as previously described, leaving handle segment 54 open in the position shown in phantom in FIG. 3. Cartridge 26 is then inserted into handle 24 with mouth 74 slidably received in base opening 42 and with the periphery of conical shoulder 78 engaging that portion of ledge 60 in handle segment 56. Handle segment 54 is then closed and snapped into position by locking means 68, so that cartridge 26 is captured within the handle cavity with shoulder 78 abutting ledge 60 and conical cartridge end 80 firmly clamped between ribs 70. Handle 24 may now be rotated with respect to brush 22, thereby twisting and squeezing cartridge 26 and ejecting toothpaste therefrom through mouth 74, brush passage 30 and openings 38 between bristles 34. When all of the toothpaste has been so dispensed after a multiplicity of uses, tab 66 may be manually grasped and pulled away from brush base 40 for releasing the locking means 68 and opening handle segment 54 with respect to handle segment 56. Handle segment 56 remains assembled to brush base 40 by means of ribs 62,64. The spent cartridge 26 may then be removed and a new cartridge assembled to the toothbrush and toothpaste dispenser in the manner previously described.

Among the advantages of the present invention thus far described, it will be appreciated that the complementary non-circular cross sections of dispenser mouth 74 and brush base opening 42, combined with sliding reception of the former into the latter, cooperate to prevent rotation of the cartridge mouth with respect to the brush while facilitating insertion and removal of the cartridge. This may be contrasted for example, with conventional disposable cartridges in prior art combined toothbrush and toothpaste dispensers which employ threaded engagement of the cartridge mouth to the dispenser. Twisting of the cartridge body to dispense toothpaste effectively tightens such threaded engagement to the point where removal of a spent cartridge is difficult for adults, and all but impossible for children. Another advantage of the invention thus far described lies in the circular symmetry of the body of the toothpaste cartridge, which permits the cartridge to be assembled to the dispenser in any of the four orientations in which mouth 74 may be received into base opening 42. It will also be noted and appreciated that dispenser shoulder 78 terminates in a relatively rigid periphery which abuts handle ledge 60 in assembly and cooperates therewith to prevent removal of mouth 74 from brush base opening 42 during continued use.

FIGS. 11–15 illustrate a modified embodiment of the invention wherein the brush **22*a* has a base 40*a* with an annular wall 44*a* surrounding and defining the cartridge mouth-receiving opening 42. A tubular wall 82 integrally and axially projects from wall 44*a*, thus forming a toothbrush and toothpaste dispenser handle which is integral with the brush itself. A longitudinally split hollow tube 84 having separate segments 86,88 is integral with an end cap 90. A pair of opposed ribs 92 (FIGS. 12 and 15) project inwardly from segments 86,88 and clamp cartridge end 80 as previously described. A radially inwardly directed circular channel 94 is formed in tubular wall 82 at an end thereof remote from opening 42 and receives by snap fit a plurality of nubs 96 formed on end cap 90 so as to lock split tube 24*a* within handle 82 while permitting relative rotation therebetween. A knurled flange 98 projects radially from end cap 90 for limiting insertion of split tube 24*a* into handle 82 and to facilitate grasping by the user. The radial edge 100 of tube 24*a* forms the circular ledge 60*a* against which the periphery of cartridge shoulder 78** abuts.

In assembly and use, a cartridge 26 is fitted into split tube **24*a* and tube 24*a* is axially telescopically inserted into handle 82. Ribs 92 clamp cartridge end 80 so that rotation of split tube 24*a* also rotates cartridge mouth 74 until the latter slides into brush base opening 42. Insertion is continued until nubs 96 snap into channel 94, after which flange 98 and thus tube 24*a* may be rotated with respect to brush 22*a* and handle 82 for dispensing toothpaste as previously described. In each of the embodiments of the invention thus far described, the brush 22 or 22*a* and the split tubular element 24 or 24*a* assembled thereto may be of integral or one-piece molded plastic construction. As previously indicated, toothpaste cartridge 26**, including the toothpaste contained therein, may be provided in accordance with otherwise conventional technology.

FIGS. 16 and 17 illustrate a cap 102 which may be assembled over brush head 32. Cap 102 comprises a generally rectangular enclosure having a top 104 and a base 106 connected to each other by an integral hinge 108. Base 106 receives brush head bristles 34 in assembly to brush 22 while top 104 lies along the opposing face of brush head 32. Outwardly projecting flanges 110 (FIG. 17) extending along the sides of base 106 are received by snap fit within inwardly projecting flanges 112 on cover 104 so as to hold the cover and base in assembly. Cover 104 is open at the end thereof remote from hinge 108 so as to encompass brush neck 28. A tab 114 projects from cover 104 adjacent to brush neck 28 and is adapted to be grasped for manually disengaging flanges 110,112 so that cap 102 may be removed from the brush head for use.

The invention claimed is:

1. A combined toothbrush and toothpaste dispenser comprising a brush having a neck with an internal passage extending therethrough, a head integral with one end of said neck with a plurality of bristles and with said passage having a first opening in said head among said bristles, and base means at the other end of said neck and including a second opening communicating with said passage, a disposable toothpaste cartridge having a mouth removably received within said second opening and held therein against rotation with respect to said base means, a collapsible body with an end remote from said mouth, and toothpaste within said body, and split hollow tubular means mounted to said base means for free rotation about said second opening and including tubular segments having opposed means projecting within said tubular means from respective ones of said segments and releasably clamping said end of said cartridge, such that rotation of said tubular means with respect to said base means causes rotation of said mouth-remote end of said cartridge clamped between said clamping means with respect to said mouth to squeeze toothpaste through said mouth at said passage among said bristles.

2. The combination set forth in claim 1 wherein said cartridge mouth and said second opening are of complementary non-circular cross section, with said mouth being adapted to be slidably received and removed from said second opening and held by said second opening against rotation with respect to said base means.

3. The combination set forth in claim 2 wherein said cartridge body includes a radial shoulder adjacent to said mouth and having a rigid periphery, and wherein said split tubular means includes means on said segments of said tubular means defining an internal ledge which abuts said rigid periphery to prevent removal of said mouth from said second opening.

4. The combination set forth in claim 3 wherein said cartridge body, including said shoulder, is of circular cross section throughout its length, with a portion of said body adjacent to said mouth-remote end tapering conically to said mouth-remote end.

5. The combination set forth in claim 1 wherein said base means includes an annular wall surrounding and defining said second opening, with at least one radially outwardly facing circumferentially continuous channel being formed in said wall, and wherein said split tubular means comprises a pair of opposed part-tubular segments joined at one end by integral hinge means and with at least one rib projecting radially inwardly from said segments and received into said channel.

6. The combination set forth in claim 5 wherein said part-tubular segments include opposed locking means for releasably locking said segments in opposed closed engagement.

7. The combination set forth in claim 6 wherein said split tubular means has a non-circular outer surface contour.

8. The combination set forth in claim 6 further comprising a tab projecting from one of said segments at an end thereof opposed to said hinge means and adapted to be manually grasped for opening said split tubular means against said locking means for removing said cartridge.

9. The combination set forth in claim 8 wherein said at least one rib projects from the other of said segments and includes means cooperating with said at least one channel in said annular wall for retaining said split tubular means on said base means when said one of said segments is opened.

10. The combination set forth in claim 9 wherein said cooperating means comprises an arcuate lateral rib projecting axially from said at least one rib and received by snap fit into a corresponding lateral channel formed in an opening side wall of said at least one channel and extending entirely around said at least one channel.

11. The combination set forth in claim 1 wherein said base means includes an annular wall surrounding and defining said second opening and a hollow tubular handle integrally projecting from said wall, said handle having an open end remote from said annular wall, and wherein said split tubular means is adapted to be slidably telescopically received within said handle.

12. The combination set forth in claim 11 wherein said handle includes a circumferential radially inwardly facing groove adjacent to said open end, and wherein said split tubular means includes means adapted to be received by snap fit into said groove and circumferentially slidable therein.

13. The combination set forth in claim 12 further comprising a knurled flange projecting from one end of said split tubular means to limit slidable insertion into said handle and to facilitate rotation of said sleeve with respect to said handle.

14. The combination set forth in claim 1 further comprising a cap adapted to be removably received over said head.

15. The combination set forth in claim 1 wherein said brush and said split tubular sleeve are of respective integral molded plastic constructions.

16. A disposable toothpaste cartridge constructed to be removably received within a toothpaste dispenser, said cartridge comprising a hollow stem mouth having an internal dispensation passage and an outer radially facing surface of non-circular cross section for removable non-rotating insertion into a corresponding dispenser opening axially of said mouth, a collapsible body including a conical shoulder projecting radially and axially from said mouth and having a rigid periphery remote from said mouth for cooperation with opposing abutment means in the dispenser to resist withdrawal of said mouth from the dispenser opening, and toothpaste within said body.

17. The toothpaste cartridge set forth in claim 16 wherein said mouth outer surface is of polygonal cross section.

18. The toothpaste cartridge set forth in claim 17 wherein said surface is of square cross section.

19. The toothpaste cartridge set forth in claim 16 wherein said cartridge body, including said shoulder, is of circular cross section throughout its length, with an end portion of said body remote from said mouth tapering conically.

* * * * *